US009526316B2

(12) United States Patent
Pires et al.

(10) Patent No.: US 9,526,316 B2
(45) Date of Patent: Dec. 27, 2016

(54) COSMETIC APPLICATOR

(71) Applicant: ZEN DESIGN SOLUTIONS LIMITED, Kowloon (CN)

(72) Inventors: Leo Clifford Pires, Basking Ridge, NJ (US); Roger Hwang, Maple (CA); Rahul Bose, New Delhi (IN); Manisha Kohli, New Delhi (IN); Iti Seth, Faridabad (IN)

(73) Assignee: ZEN DESIGN SOLUTIONS LIMITED, Kowloon, Hong Kong (CN)

( * ) Notice: Subject to any disclaimer, the term of this patent is extended or adjusted under 35 U.S.C. 154(b) by 172 days.

(21) Appl. No.: 14/278,209

(22) Filed: May 15, 2014

(65) Prior Publication Data

US 2015/0327654 A1 Nov. 19, 2015

(30) Foreign Application Priority Data

May 21, 2013 (IN) ..... 1519/del/2013

(51) Int. Cl.
*A45D 40/26* (2006.01)
*A46B 9/02* (2006.01)

(52) U.S. Cl.
CPC ..... *A45D 40/262* (2013.01); *A46B 9/021* (2013.01); *A46B 2200/1053* (2013.01)

(58) Field of Classification Search
CPC .. A45D 40/262; A45D 40/261; A45D 40/264; A45D 40/265; A45D 40/28; A45D 29/11; A45D 2200/10; A45D 2200/1009; A45D 2200/1036; A45D 2200/1054; A45D 2200/1072; A46B 9/028; A46B 9/005; A46B 9/02; A46B 9/021; A46B 9/025;A46B 9/026; A46B 9/06; A46B 2200/10; A46B 2200/1006; A46B 2200/1013; A46B 2200/102; A46B 2200/106; A46B 2200/1046
USPC ..... 132/218, 317, 320, 126, 139, 140, 141, 132/142, 73, 313, 318
See application file for complete search history.

(56) References Cited

U.S. PATENT DOCUMENTS

| | | | | |
|---|---|---|---|---|
| 4,056,111 | A | 11/1977 | Mantelet | |
| 4,397,326 | A | 8/1983 | Formica | |
| 4,545,393 | A | 10/1985 | Gueret et al. | |
| 4,586,520 | A * | 5/1986 | Brittain | 132/218 |
| 4,635,659 | A | 1/1987 | Spatz | |
| 5,482,059 | A * | 1/1996 | Miraglia | 132/218 |
| 6,343,607 | B1 * | 2/2002 | Gueret | 132/218 |
| 6,546,937 | B2 * | 4/2003 | Gueret | 132/218 |
| 6,591,842 | B2 * | 7/2003 | Gueret | 132/218 |

(Continued)

FOREIGN PATENT DOCUMENTS

| | | |
|---|---|---|
| FR | 2906115 | 3/2008 |
| JP | 2003111616 | 4/2003 |

(Continued)

*Primary Examiner* — Rachel Steitz
(74) *Attorney, Agent, or Firm* — Patterson + Sheridan, LLP

(57) ABSTRACT

A cosmetic applicator comprising at least three successive projecting parts off-centered relative to a central longitudinal axis of the cosmetic applicator. Each of the at least three successive projecting parts comprises at least one application element. The cosmetic applicator of the present disclosure may be used for cosmetic and care applications such as on skin or on keratinous fibers in the area of mascara application, lash care, nail care, mascara removal, lip application, hair coloring and hair repair etc.

14 Claims, 8 Drawing Sheets

(56) References Cited

U.S. PATENT DOCUMENTS

| | | | | |
|---|---|---|---|---|
| 7,314,050 | B2 * | 1/2008 | Hartstock et al. | 132/218 |
| 7,789,094 | B2 * | 9/2010 | Gueret | 132/218 |
| 7,810,509 | B2 * | 10/2010 | Kuzuu | 132/218 |
| 7,827,998 | B2 * | 11/2010 | Rebours | 132/218 |
| 7,841,348 | B2 * | 11/2010 | Rebours | 132/218 |
| 7,856,994 | B2 * | 12/2010 | Rebours | 132/218 |
| 8,042,554 | B2 * | 10/2011 | Dumler | 132/218 |
| 8,047,213 | B2 * | 11/2011 | Yasuda | 132/218 |
| 8,091,562 | B2 * | 1/2012 | Manici et al. | 132/218 |
| 8,091,566 | B2 * | 1/2012 | Salciarini | 132/320 |
| 8,096,306 | B2 * | 1/2012 | Malvar et al. | 132/218 |
| 8,291,920 | B2 * | 10/2012 | Takata et al. | 132/218 |
| 8,336,560 | B2 * | 12/2012 | Dumler et al. | 132/218 |
| 8,783,268 | B2 * | 7/2014 | Gueret | 132/218 |
| 8,919,351 | B1 * | 12/2014 | Wang | 132/218 |
| 2005/0115011 | A1 * | 6/2005 | Petit | 15/191.1 |
| 2005/0217691 | A1 * | 10/2005 | Petit | 132/320 |
| 2005/0257338 | A1 * | 11/2005 | Brandli | 15/106 |
| 2006/0249171 | A1 * | 11/2006 | Kurek et al. | 132/218 |
| 2008/0060668 | A1 * | 3/2008 | Legassie | 132/218 |
| 2009/0241989 | A1 * | 10/2009 | MacNeil | 134/6 |
| 2010/0037911 | A1 * | 2/2010 | Kim | 132/218 |
| 2011/0226276 | A1 * | 9/2011 | Limongi et al. | 132/218 |
| 2011/0284021 | A1 * | 11/2011 | Gueret | 132/218 |
| 2012/0082503 | A1 * | 4/2012 | Gueret | 401/122 |
| 2013/0104924 | A1 * | 5/2013 | Higgins | 132/218 |
| 2013/0104925 | A1 * | 5/2013 | Caulier | 132/218 |
| 2013/0276812 | A1 * | 10/2013 | Kulik et al. | 132/218 |
| 2015/0110541 | A1 * | 4/2015 | Uresti et al. | 401/129 |

FOREIGN PATENT DOCUMENTS

| | | |
|---|---|---|
| WO | WO 2006/124228 | 11/2006 |
| WO | WO 2006/125122 | 11/2006 |

* cited by examiner

COSMETIC APPLICATOR

CROSS-REFERENCE TO RELATED APPLICATION

This application claims benefit of Indian Provisional Application Ser. No. 1519/DEL/2013, filed May 21, 2013, which is incorporated by reference in its entirety.

BACKGROUND

Field of the Invention

Embodiments of the present disclosure generally relate to a cosmetic applicator. More particularly, the disclosure relates to a cosmetic applicator comprising at least one projecting part off-centered relative to a longitudinal axis of the applicator. The cosmetic applicator of the present disclosure may be used for cosmetic and care applications such as on skin or on keratinous fibers in the area of mascara application, lash care, nail care, mascara removal, lip application, hair coloring and hair repair etc.

Description of the Related Art

Conventionally, cosmetic applicators known for applying mascara to the eyelashes include a stem, at one end of which is connected an applicator member and at the other end is provided a handle for gripping. Generally, applicators also comprise an applicator member molded with a support and teeth disposed around the support and projecting outwards from the support.

Patent application FR 2 906 115, U.S. Pat. No. 4,635,659, and international applications WO 2006/124228 and WO 2006/125122 disclose mascara applicators having teeth oriented towards the front or towards the rear of the applicator, wherein teeth are of length that is shorter than the local diameter of the support.

In U.S. Pat. No. 4,545,393, the set of teeth extends perpendicularly to the longitudinal axis of the support.

Cosmetic applicator such as a mascara applicator deposits and distributes the product i.e. mascara all over the lashes. As mascara, inherently, is a product that is difficult to apply because of the sensitive target area of application, it is desirable that no clumping of product occurs and the lashes are separated and combed evenly. However, all the desired effects are not possible with a single mascara brush. This is because the eyelashes are soft, flexible, delicate and in close proximity to very sensitive eye tissue. Further, a user requires twisting and/or turning his/her hands in a particular manner to achieve a particular desired effect on the lashes and not all users are adapt in being able to gradually twist their wrist along with the outward stroke of application on the lashes. Continuous innovations in this area are being made to provide the user with an applicator that gives him/her a better application and makes the whole application effortless to the consumer.

Mascara brushes that rotate during application are known. U.S. Pat. No. 4,056,111 describes a motor-driven, rotatable mascara brush. U.S. Pat. No. 4,397,326 describes a non-motorized mascara brush, the head of which is free to rotate and does so when the brush head contacts the eyelashes during application. It is the act of brushing that causes the rotation. However, the usage of these applicators is cumbersome for the user and some users find it frightening to use the battery-powered applicators.

Also, known is a mascara brush having a configuration in which bristles are clamped between two metal wires in an intersecting configuration with respect to the metal wires, and the metal wires are twisted into a spiral shape so that the bristles are fastened between the loops, is widely used as a coating implement for the application of mascara. Here, in a conventional cosmetic applicator, the lengths of the respective bristles extending radially from the metal wires are same.

Japanese Patent Application No. 2003-111616 discloses a cosmetic applicator in which the content liquid of mascara or the like can be amply and uniformly held in the direction of length and circumferential direction of the cosmetic applicator by applying this liquid from the central portions to the tip end portions of the respective applicator members, so that a good volume application effect can be obtained by a coating operation without any further addition of the liquid. The bristles are disposed between metal support wires so as to intersect with these wires, and the support wires are wound in a spiral configuration, so that a coating brush part is formed. In this cosmetic coating brush, the coating brush part is a part in which long brush bristles and short brush bristles are disposed alternately and symmetrically with the support wires as an axis in the cross section oriented in the axial direction of the coating brush part. In such a structure, however, depending on the disposition of the two types of rigid bristles, adhesion of the liquid may be non-uniform, so that uniform coating of the eyelashes is difficult, as a result of short brush bristles being concentrated in certain portions, and long brush members being concentrated in other portions.

If mascara is merely applied in large amounts, the painstakingly achieved attractiveness of mascara is reduced substantially. The removal of excessively adhering mascara and balls of mascara, and combing that blends the mascara into the eyelashes, influence the mascara finish. The mascara brush that is used for this finishing work is important.

There exists a need to benefit from an applicator that enables novel makeup effects to be achieved on the hair, the eyelashes, or the eyebrows, whether or not they are already coated in a composition, that is easy to use and that improves the application of the composition, the covering of the hair, the eyelashes, or the eyebrows with composition, and the lengthening, the separation and the curling thereof.

SUMMARY

Embodiments of the present disclosure generally relate to a cosmetic applicator comprising at least one projecting part off-centered relative to a central longitudinal axis of the applicator. More particularly, the disclosure relates to a cosmetic applicator comprising a support and at least one projecting part off-centered relative to a central longitudinal axis of the support. The cosmetic applicator of the present disclosure may be used for cosmetic and care applications such as on skin or on keratinous fibers in the area of mascara application, lash care, nail care, mascara removal, lip application, hair coloring and hair repair etc.

According to an embodiment of the disclosure, there is provided a cosmetic applicator assembly including a gripping member, a stem and a cosmetic applicator. The stem has a proximal end and a distal end. The proximal end of the stem is connected to the gripping member while the cosmetic applicator is connected to the distal end of the stem.

According to another embodiment of the disclosure, the cosmetic applicator includes a support having a central longitudinal axis and application elements extending outward from the support. According to an alternate embodiment of the disclosure, the support may be rectilinear or curved.

According to another embodiment of the disclosure, the application elements extending from the support form at least one projecting part off-centered relative to the central longitudinal axis of the support.

According to another embodiment of the disclosure, the cosmetic applicator includes a twisted wire support having a central longitudinal axis and the application elements are disposed between the twisted wire support, wherein the application elements extend outward from the twisted wire support.

According to another embodiment of the disclosure, the cosmetic applicator includes a molded support having a central longitudinal axis and application elements extending outward from the molded support. The support may present a cross-section that is circular or non-circular over a major fraction of its length. The support may or may not be of generally circularly-symmetrical shape. Over at least a fraction of its length, the support may present a cross-section, taken perpendicularly to its central longitudinal axis, of shape selected from the following list: circular; semi-circular; flat; elliptical; oblong; semi-elliptical; polygonal; triangular; rectangular; square; pentagonal; hexagonal; heptagonal; octagonal; and semi-polygonal. The shape may vary along the central longitudinal axis of the support.

The support may include a cross-section, perpendicular to its central longitudinal axis, of shape that varies along the central longitudinal axis of the support. By way of example, the support may have a cross-section of shape that is constant or inconstant along the central longitudinal axis of the support, e.g. over at least half, or three-fourth, or complete length of a portion of the support carrying the application elements.

According to another embodiment of the disclosure, the cosmetic applicator includes a metallic support having a central longitudinal axis and the application elements are attached to the metallic support via magnetic means.

According to another embodiment of the disclosure, the application elements include teeth, tines, bristles, fibers, discs, flock, sponge and the like.

According to another embodiment of the disclosure, the application elements extend perpendicularly to the central longitudinal axis of the support. The application elements on the support may extend out in parallel longitudinal rows with respect to the central longitudinal axis of the support. Alternatively, the application elements may extend radially parallel or in any other suitable arrangement. At least one of the application elements may extend towards the rear of the cosmetic applicator and at least one of the application elements may extend towards the front of the cosmetic applicator.

According to another embodiment of the disclosure, the application elements extending outward from the support form at least one projecting part comprising a curved outer surface or a sharp edged outer surface with respect to the central longitudinal axis of the support.

According to another embodiment of the disclosure, shape of the projecting part is selected from sphere, ellipse, rhombus, polygonal, cylindrical, conical and the like.

According to another embodiment of the disclosure, length of the application elements of at least one projecting part is not uniform.

According to another embodiment of the disclosure, length of the application elements of the at least one projecting part progressively increases and then decreases from its one end to another end.

According to another embodiment of the disclosure, the length of the application elements of the at least one projecting part is shorter towards end points of the projecting part and longer towards middle of the projecting part.

According to another embodiment of the disclosure, the at least one projecting part is off-centered relative to the central longitudinal axis of the support. The at least one projecting part has a centre which does not lie on the central longitudinal axis of the support.

According to an alternate embodiment of the disclosure, at least one projecting part is radially asymmetric with respect to the central longitudinal axis of the support.

According to another embodiment of the disclosure, the cosmetic applicator comprises two or more successive projecting parts such that a line passing through centers of the at least two successive projecting parts is not parallel to the central longitudinal axis of the support.

According to another embodiment of the disclosure, the cosmetic applicator comprises two or more successive projecting parts such that a line passing through the centers of the at least two successive projecting parts is not parallel to the central longitudinal axis of the support and does not intersect the central longitudinal axis of the support.

The term "central longitudinal axis of the support" is used to designate a line that joins together centers of gravity of the cross-sections of the support. The central longitudinal axis may be an axis of symmetry for the support, in particular when the support presents a cross-section that is circular or that has the general shape of a regular polygon.

According to another embodiment of the disclosure, the cosmetic applicator comprises at least two faces.

According to another embodiment of the disclosure, the cosmetic applicator comprises a first face and a second face, the second face is opposite to the first face. The first face and the second face lie on opposite sides of a plane containing the central longitudinal axis of the cosmetic applicator.

According to another embodiment of the disclosure, the application elements of at least one projecting part on the first face differ in length with the diametrically opposite application elements present on the second face.

According to another embodiment of the disclosure, the application elements of the at least one projecting part on the first face are of shorter length as compared to the length of diametrically opposite application elements on the second face.

According to another embodiment of the disclosure, the cosmetic applicator comprises at least three projecting parts wherein at least one projecting part of the at least three projecting parts is off centered towards the first face and is placed between two projecting parts that are off centered towards the second face.

According to another embodiment of the disclosure, the cosmetic applicator comprises at least three projecting parts wherein at least one projecting part of the at least three projecting parts is off centered towards the second face and is placed between two projecting parts that are off centered towards the first face.

According to another embodiment of the disclosure, the cosmetic applicator comprises at least three successive projecting parts wherein at least one projecting part having application elements of shorter length on first face of the cosmetic applicator is placed between two projecting parts having application elements of longer length on the first face of the cosmetic applicator. Such a placement of the projecting parts on the support of the cosmetic applicator and in particular mascara applicator results in the formation of an overall inner curve having at least three lift zones on the first face. The overall inner curve of the cosmetic applicator defines a concave area on the first face of the cosmetic applicator. The three lift zones will help to lift eyelashes from both corners and center. The overall inner curve of the first face of the applicator picks bulk and catches entire fan of the eyelash in single stroke, thereby adding volume to the eyelashes.

According to further embodiment of the disclosure, the cosmetic applicator comprises at least three successive projecting parts wherein at least one projecting part having application elements of longer length on second face is placed between the two projecting parts having application elements of shorter length on the second face. Such a placement of the projecting parts in the cosmetic applicator and in particular mascara applicator results in the formation of an overall outer curve having at least three combing zones on the second face. The overall outer curve of the cosmetic applicator defines a convex area on the second face of the cosmetic applicator. Each of the three combing zones is used individually at an angle to enable easy reach to the corner and centre eyelashes and combs through them creating separation between the eyelashes. The overall outer curve of the second face of the cosmetic applicator picks up bulk sparsely and is optimized for combing and separating the eyelashes, after application. The overall outer curve also helps in curling of the eyelashes.

According to another embodiment of the disclosure, the cosmetic applicator gives a wriggling motion as the applicator is twirled onto the eyelashes during application. The wriggling motion help in curling of the eyelashes without the need of complex rotating mascara applicators.

According to another embodiment of the disclosure, the applicator may be used on its own, e.g. in order to improve the makeup effect of a composition that has already been applied to the eyelashes or eyebrows, skin or lips, or it may be used after loading the application elements with a composition, loading being performed either by depositing the composition on the application elements, or by bringing the application elements into contact with a cake of composition, or by dipping the applicator into a receptacle containing the composition.

When the applicator is used in association with a receptacle that is provided with a wiper member, the shape of the applicator could result in unequal wiping that could be advantageous for the makeup effect. For example, the outer curve having convex area, of the applicator is wiped more, and is better able to separate and extend the eyelashes. The inner curve having concave area, of the applicator could be loaded more heavily with composition, and could be used to apply makeup to eyelashes or eyebrow hairs.

According to another embodiment of the disclosure, the application elements extending outward from the support form two or more successive projecting parts with respect to the longitudinal axis of the support such that there is no gap between the two successive projecting parts.

According to another embodiment of the disclosure, the application elements extending outward from the support comprise two or more successive projecting parts with respect to the longitudinal axis of the support such that there is a gap between the two successive projecting parts. The gap can be occupied by other application elements having uniform or non-uniform length, and may include teeth, tines, bristles, fibers, flock, sponge, disc, and the like.

According to another embodiment of the disclosure, the at least two faces of the cosmetic applicator comprise of two different materials having different properties. The two different materials can be of same chemical composition or different chemical composition but they vary in their hardness. The molded support and the application elements of one of the at least two faces of the cosmetic applicator comprise of a hard material; and the molded support and the application elements of other of the at least two faces of the applicator comprise of soft material. As an exemplary embodiment, in a mascara applicator, the at least two faces may comprise a hard comb part and a soft application part. At least one of the two faces of the cosmetic applicator includes at least 10 percent of the applicator.

According to another embodiment of the disclosure the molded support of one of the at least two faces of the applicator has a cavity that can interlock a complementary profiled molded support of other of the at least two faces of the applicator.

These and further aspects which will be apparent to the expert of the art are attained by a cosmetic applicator in accordance with the drawings of the present disclosure.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
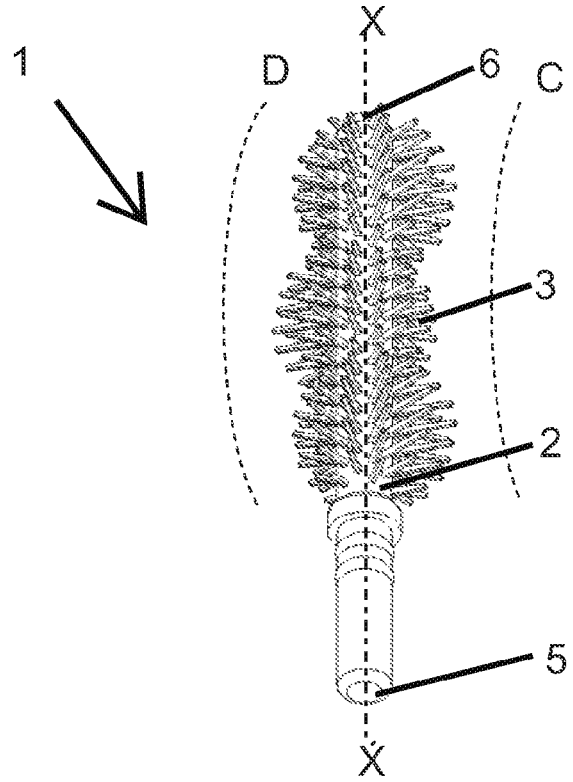
FIG. 1 illustrates a perspective view of the cosmetic applicator according to one embodiment of the disclosure.
Figure 2:
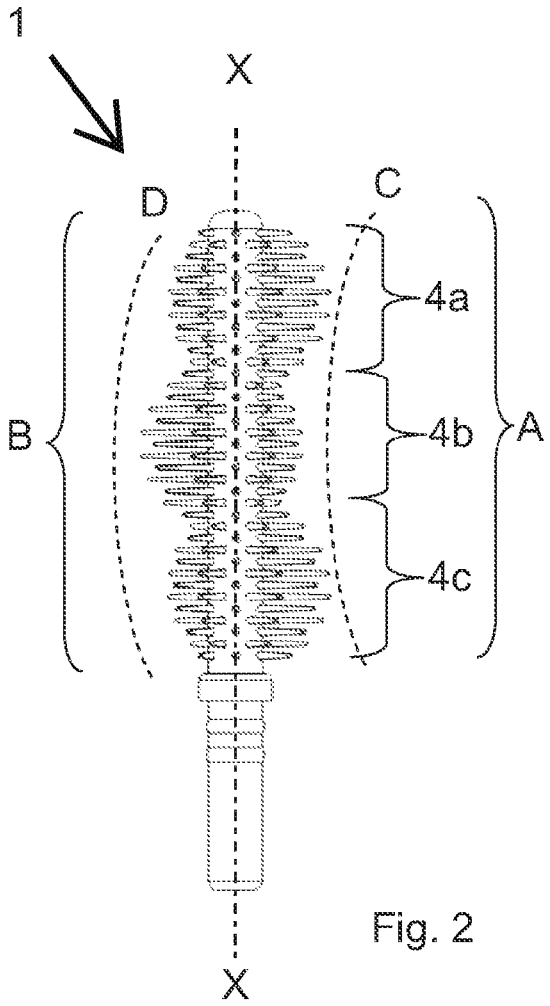
FIG. 2 illustrates a front view of the cosmetic applicator of FIG. 1.
Figure 3:
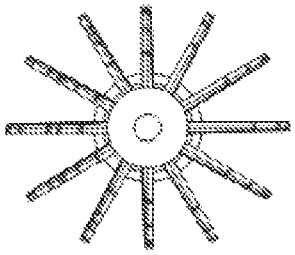
FIG. 3 illustrates a top view of the cosmetic applicator of FIG. 1.
Figure 4:
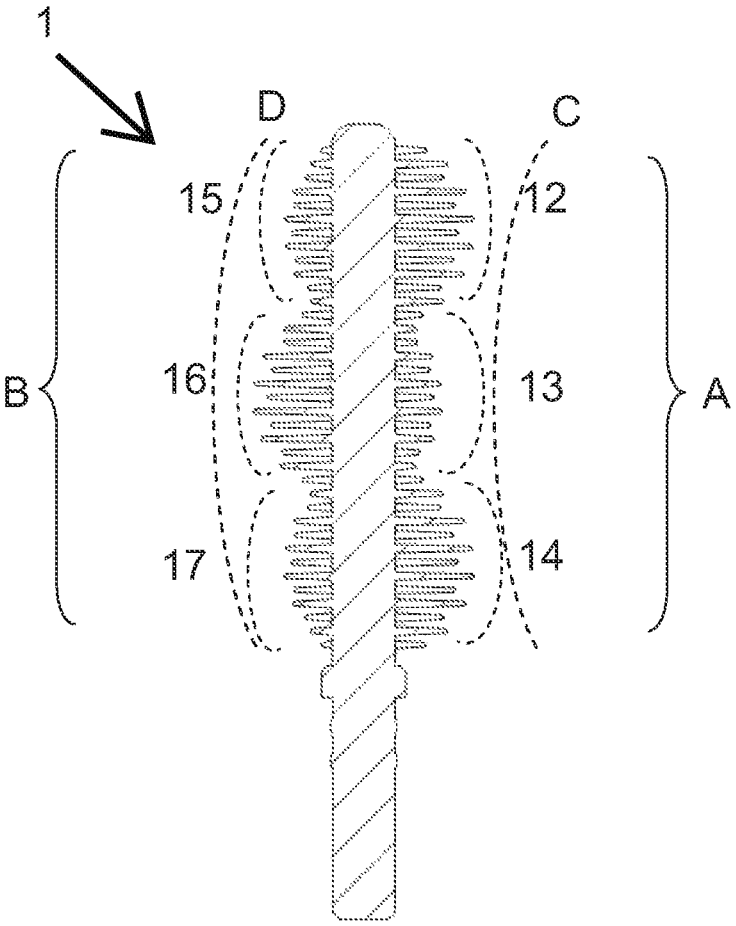
FIG. 4 illustrates a longitudinal sectional view along the axis X---X of the cosmetic applicator of FIG. 2.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

FIGS. 1 through to 4 illustrate a cosmetic applicator 1 according to one embodiment of the disclosure.

As shown in FIGS. 1 to 4, the cosmetic applicator 1 includes a molded support 2 extending along a central longitudinal axis X---X and having a proximal end 5 and a distal end 6. The application elements 3 extend outward from the molded support 2. It will be apparent to a person having ordinary skill in the art that the support may include a twisted wire support, wherein the application elements extend outward from the twisted wire support. It will also be apparent to a person having ordinary skill in the art that the support may present a cross-section that is circular or non-circular over a major fraction of its length. The support may or may not be of generally circularly-symmetrical shape. Over at least a fraction of its length, the support may present a cross-section, taken perpendicularly to its longitudinal axis, of shape selected from the following list: circular; semi-circular; flat; elliptical; oblong; semi-elliptical; polygonal; triangular; rectangular; square; pentagonal; hexagonal; heptagonal; octagonal; and semi-polygonal. The shape may vary along the central longitudinal axis X---X of the support 2.

The application elements 3 are molded integrally with the support 2 out of thermoplastic material and extend perpendicularly to the central longitudinal axis X---X of the support 2. The application elements 3 are arranged on the support 2 in parallel rows extending along the longitudinal axis of the support. According to another embodiment, the application elements 3 may be arranged on the support 2 in non parallel rows extending along the central longitudinal axis X---X of the support 2. For molding the application elements 3, it is possible to use a thermoplastic material that is optionally relatively rigid or soft, e.g. styrene-ethylene-butadiene-styrene (SEBS), a silicone, latex, butyl rubber, ethylene-propylene-terpolymer rubber (EDPM), a nitrile rubber, a thermoplastic elastomer, a polyester elastomer, polyamide, polyethylene, or vinyl elastomer, a polyolefin such as polyethylene (PE) or polypropylene (PP), polyvinyl chloride (PVC), ethylene vinyl acetate copolymer (EVA), polystyrene (PS), polyethylene terephthalate (PET), polyacetal (POM), polyamide (PA), or polymethyl methacrylate (PMMA). In particular, it is possible to use the materials known under the trademarks Hytrel™, Cariflex™, Alixine™, Santoprene™, Pebax™, this list not being limiting.

The application elements 3 extending outward from the support 2 of the cosmetic applicator 1 form three successive projecting parts 4*a*, 4*b* and 4*c*. The projecting parts 4*a*, 4*b* and 4*c* extend from the circumferential region of the support 2 and each of the projecting parts 4*a*, 4*b*, 4*c* has a curved outer surface with respect to the central longitudinal axis X-X of the support 2. It will be apparent to a person having ordinary skill in the art that the shape of the projecting part may be selected from sphere, ellipse, rhombus, polygonal and the like.

Each of the projecting parts 4*a*, 4*b* and 4*c* comprises a plurality of application elements 3 of varying length. The length of the application elements 3 of each of the projecting parts 4*a*, 4*b* and 4*c* is shorter towards end points of each of the projecting parts and longer towards middle of each of the projecting parts 4*a*, 4*b* and 4*c*. The application elements 3 of each of the projecting parts 4*a*, 4*b* and 4*c* are shown to increase in length towards the middle of each of the projecting parts 4*a*, 4*b* and 4*c* and decrease in length towards the end points of each of the projecting parts 4*a*, 4*b* and 4*c*. The projecting parts 4*a*, 4*b* and 4*c* are off-centered relative to the central longitudinal axis X---X of the support 2. It will be apparent to a person skilled in the art that the projecting parts 4*a*, 4*b* and 4*c* could be of different size. The size of the projecting part is determined by the length of the greatest transverse axis of the projecting part.

The cosmetic applicator 1 comprises a first face A and a second face B, wherein the first face A and the second face B are present opposite to each other. The first face A and the second face B lie on opposite sides of a plane containing the central longitudinal axis X-X of the support 2.

The projecting part 4*b* is off centered towards the second face B and is placed between two projecting parts 4*a* and 4*c* that are off centered towards the first face A of the cosmetic applicator 1. The application elements 3 of the projecting part 4*b* on the first face A are shorter in length as compared to the length of substantially diametrically opposite application elements 3 of the projecting part 4*b* on the second face B of the cosmetic applicator 1. The application elements 3 of the projecting part 4*a* and 4*c* on the first face A are longer in length as compared to the length of substantially diametrically opposite application elements 3 of the projecting part 4*a* and 4*c* on the second face B of the cosmetic applicator 1.

The projecting part 4*b* having application elements 3 of shorter length on the first face A of the cosmetic applicator 1 is placed between two projecting parts 4*a* and 4*c* having application elements 3 of longer length on the first face A of the cosmetic applicator. Such a placement of the projecting parts 4*a*, 4*b* and 4*c* on the support 2 of the cosmetic applicator 1 and in particular mascara applicator results in the formation of an overall inner curve C on the first face A of the cosmetic applicator 1. The overall inner curve C of the cosmetic applicator 1 defines a concave area on the first face A of the cosmetic applicator 1. Further, the inner curve C defines at least three lift zones 12, 13, 14 formed by the curved surfaces of the projecting parts 4*a*, 4*b* and 4*c* on the first face A that help the cosmetic applicator 1 to lift the eyelashes from center and corners of eyes. The overall inner curve C of the first face A of the applicator picks up bulk and catches the entire fan of the eyelash in single stroke, thereby adding volume to the eyelashes.

The projecting part 4*b* having application elements 3 of longer length on the second face B is placed between the two projecting parts 4*a* and 4*c*, having application elements 3 of shorter length on the second face B. Such a placement of the projecting parts 4*a*, 4*b* and 4*c* on the support 2 of the cosmetic applicator 1 and in particular mascara applicator results in the formation of an overall outer curve D on the second face B of the cosmetic applicator 1. The overall outer curve D of the cosmetic applicator 1 defines a convex area on the second face B of the cosmetic applicator 1. The outer curve D on the second face B further includes three combing zones 15, 16, 17 formed by the curved surfaces of the projecting parts 4*a*, 4*b* and 4*c* on the second face B. The cosmetic applicator 1 can be held at multiple orientations, such that each of the three combing zones 15, 16, 17 can be used individually by adjusting the orientation of cosmetic applicator 1, thereby enabling the cosmetic applicator 1 to reach to the corners and centre eyelashes easily and combs through them creating separation between the eyelashes. The overall outer curve D of the second face of the cosmetic applicator 1 picks up bulk sparsely and is optimized for combing and separating the eyelashes, after application. The overall outer curve D also helps in curling of the eyelashes.

According to one embodiment of the disclosure, the first face A and the second face B of the cosmetic applicator 1 are fabricated from materials having different properties. The first molded face A is fabricated from a material which is softer than a material from which the second molded face B is fabricated. In one embodiment, the first molded face A is fabricated from a material having a hardness of less than about 80 Shore D scale (ShD). In another embodiment, the second molded face B is fabricated from a material having a hardness of greater than about 20 Shore D scale (ShD). It is also contemplated that the material of the first molded face A may be harder than the material of the second molded face B. The different materials of the first and second faces A and B may have properties that are attractive and non-attractive to mascara, have different stiffness, have different tactile feel, have different color, have different chemical nature, have different magnetic property, have different temperature property and/or other property. The combination of the different materials utilized for the support 2 and the application elements 3 of the first and the second faces A and B, allow different effects to be achieved on application. The hard material has been found to provide separation of the lashes during the application of mascara, while the softer material provides lift and volume. Thus, the inner curve C of the first face A of the cosmetic applicator 1 including three lift zones 12, 13, 14 formed from softer material picks bulk and catches entire fan of the eyelash in single stroke, thereby adding volume to the eyelashes. The overall outer curve D of the second face B of the cosmetic applicator 1 including three combing zones 15, 16, 17 formed from harder material picks up bulk sparsely and is optimized for combing and separating the eyelashes, after application.

Figure 5:
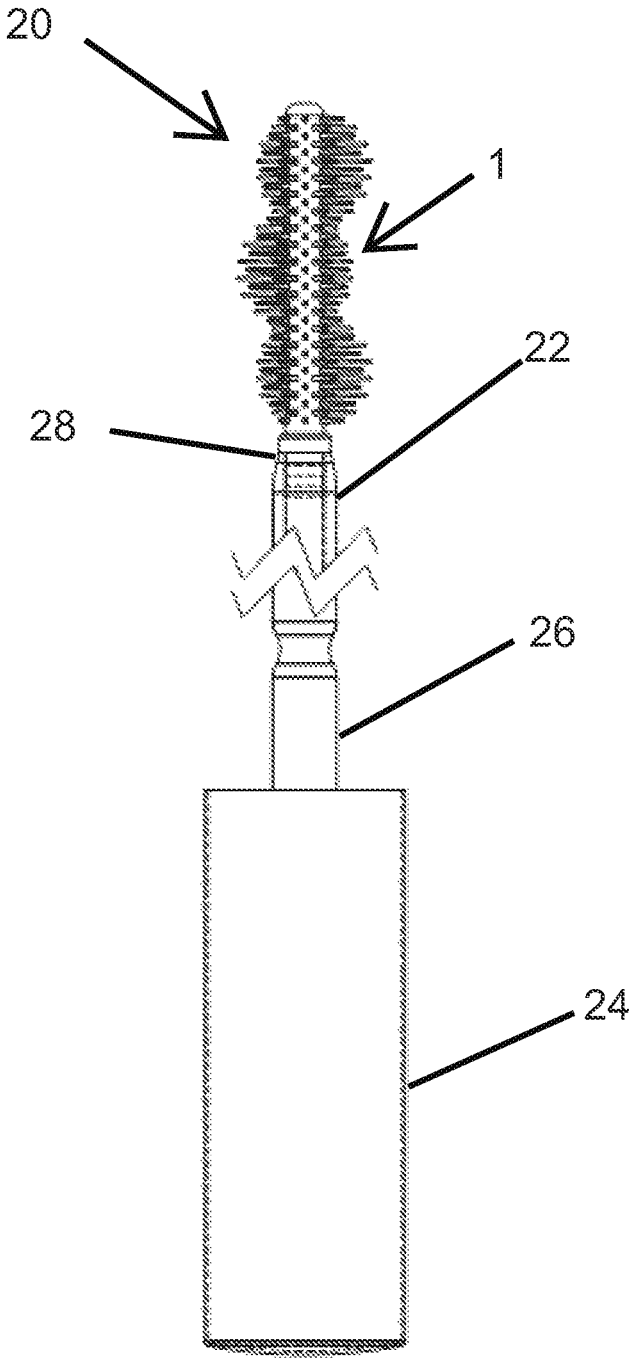
FIG. 5 illustrates a cosmetic applicator assembly comprising the cosmetic applicator of FIG. 1 according to an embodiment of the present disclosure.

FIG. 5 illustrates another embodiment of the present disclosure. As shown in the FIG. 5, a cosmetic applicator assembly 20 includes a cosmetic applicator 1 as described above, a stem 22 and a gripping member 24. The stem 22 has a proximal end 26 and a distal end 28. The proximal end 26 of the stem 22 is connected to the gripping member 24, while the cosmetic applicator 1 is connected to the distal end 28 of the stem 22. The cosmetic applicator 1 may be connected to the distal end 28 of the stem 22 in any suitable manner, for example the applicator 1 may be connected to the distal end 28 utilizing plastic welding techniques, adhesives or other suitable fastening technique.

Figure 6A:
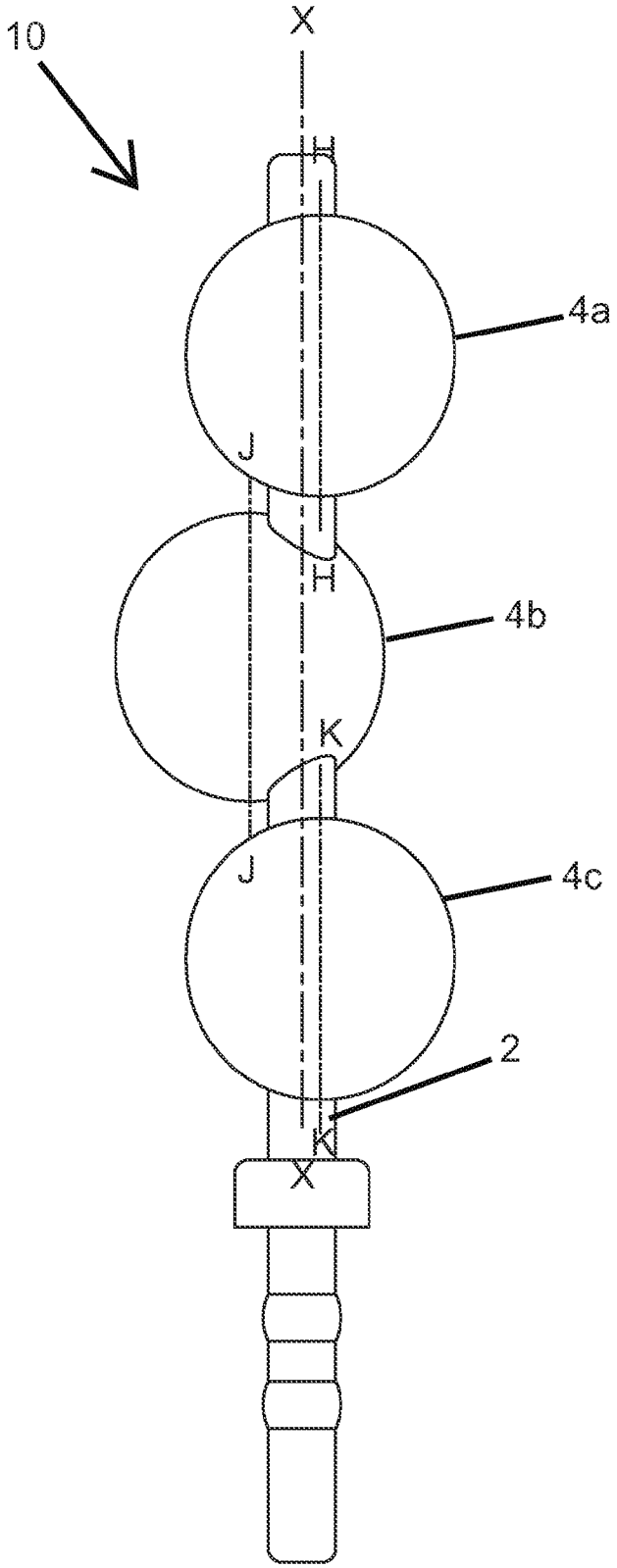
FIG. 6*a* illustrates longitudinal axes of projecting parts of a cosmetic applicator according to one embodiment of the disclosure.

As shown in the FIG. 6*a*, a cosmetic applicator 10 comprises three projecting parts 4*a*, 4*b* and 4*c* extending outward from circumferential region of a support 2 having a central longitudinal axis X-----X. Each of the three projecting parts 4*a*, 4*b* and 4*c* has its own central longitudinal axis. The projecting part 4*a* has a central longitudinal axis H---H, the projecting part 4*b* has a central longitudinal axis J---J, and the projecting part 4*c* has a central longitudinal axis K---K.

Figure 6B:
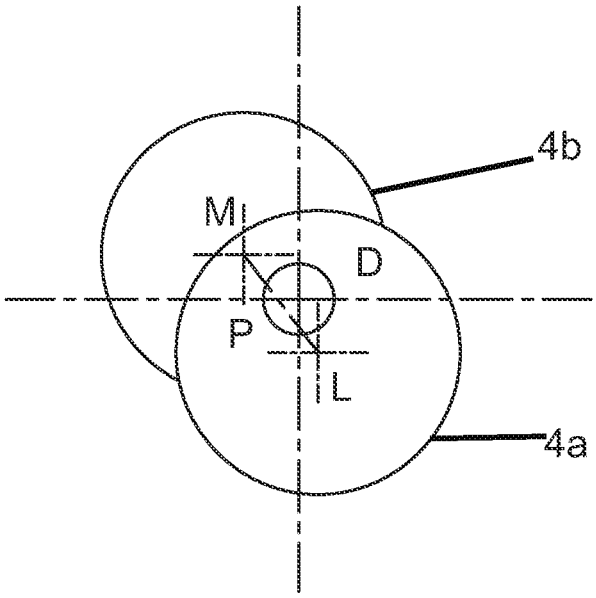
FIG. 6*b* illustrates top view of the cosmetic applicator of FIG. 6*a* in a plane perpendicular to the central longitudinal axis of the support.

According to a further embodiment of the present disclosure, a line passing through the centers or through two points lying on the respective central longitudinal axes of the two successive projecting parts of the cosmetic applicator will not be parallel to the central longitudinal axis of the support and will not intersect the central longitudinal axis of the support. FIG. 6*b* shows a top view of the cosmetic applicator 10 on a plane perpendicular to the central longitudinal axis X-----X of the support 2. As shown in FIG. 6*a* and FIG. 6*b*, L is the point lying on the central longitudinal axis H---H of the projecting part 4*a* and M is the point lying on the central longitudinal axis J---J of the projecting part 4*b*. The central longitudinal axis H--H, J--J, K--K of the projecting parts 4*a*, 4*b* and 4*c* extend normal to said plane and the central longitudinal axis H-----H, J--J of the adjacent projecting parts 4*a*, 4*b* passes through points L and M on said plane. D is a point lying on the central longitudinal axis X---X of the support 2. A line P passing through points L and M, lying on the central longitudinal axis H---H of the projecting part 4*a* and on the central longitudinal axis J---J of the adjacent projecting part 4*b* respectively does not pass through the point D lying on the central longitudinal axis X---X of the support 2 and is not parallel to the central longitudinal axis X--X of the support 2.

Figure 7A:
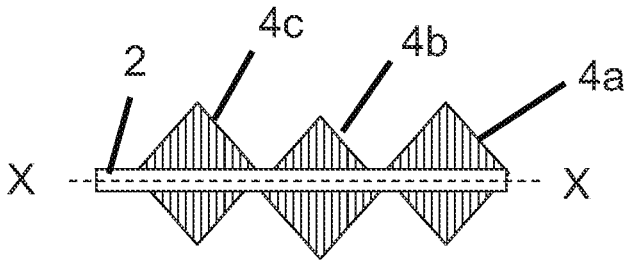
FIG. 7*a*-9*b* illustrates sectional views of cosmetic applicators according to various embodiments of the disclosure.

FIG. 7*a* shows a cosmetic applicator according to another embodiment of the present disclosure, where all projecting parts 4*a*, 4*b* and 4*c* of the cosmetic applicator are arranged off-centered relative to a central longitudinal axis X--X of a support 2 and each of the projecting parts 4*a*, 4*b* and 4*c* comprises a sharp edge on the outer surface.

Figure 7B:
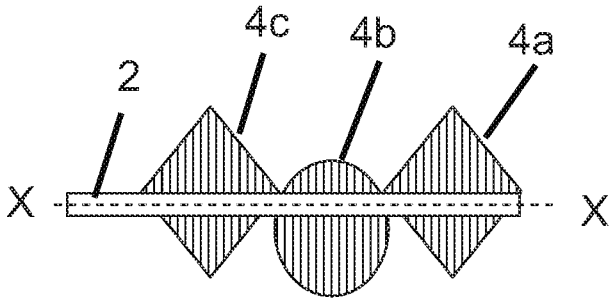

FIG. 7*b* shows a cosmetic applicator according to further embodiment of the present disclosure. As shown in FIG. 7*b* all projecting parts 4*a*, 4*b* and 4*c* of the cosmetic applicator are arranged off-centered relative to a central longitudinal axis X--X of a support 2 and the shape of at least one of the projecting parts is different from shape of rest of the projecting parts. The projecting part 4*b* has a curved outer surface whereas the projecting parts 4*a* and 4*c* have a sharp edge on their outer surface. It will be apparent to a person having ordinary skill in the art that the shape of the projecting parts can be selected from a sphere, ellipse, rhombus, polygonal and the like, and that they could be combined or arranged in all possible permutations or combinations.

Figure 8A:
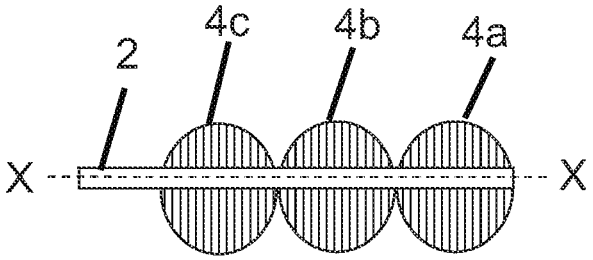
Figure 8B:
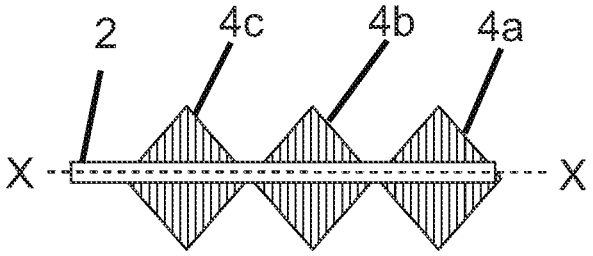
Figure 8C:
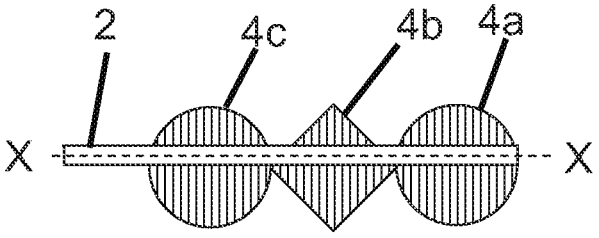

FIGS. 8*a* to 8*c* show further embodiments of the present disclosure. The cosmetic applicators shown in FIGS. 8*a*-8*c* comprise projecting parts 4*a*, 4*b*, 4*c* all of which are off-centered relative to a central longitudinal axis X--X of a support 2 and wherein all the projecting parts 4*a*, 4*b*, 4*c* are arranged on the support in the manner that every application element on a first face of projecting parts 4*a*, 4*b*, 4*c* has a length shorter than the length of diametrically opposite application element present on the second face. FIG. 8*a* shows a cosmetic applicator comprising projecting parts 4*a*, 4*b* 4*c* each having a curved outer surface. FIG. 8*b* shows a cosmetic applicator comprising projecting parts 4*a*, 4*b* 4*c* having a sharp edge on their outer surface. FIG. 8*c* shows a cosmetic applicator comprising projecting parts 4*a*, 4*b* 4*c*, wherein projecting parts 4*a* and 4*c* have a curved outer surface and projecting part 4*b* have a sharp edge on the outer surface. The length of the application elements of all the projecting parts 4*a*, 4*b*, 4*c* of the cosmetic applicator in FIG. 8*a* to 8*c*, on first face of the support 2 is shorter than the length of diametrically opposite application elements present on the second face. It will be apparent to a person having ordinary skill in the art that the shape of the projecting parts of the cosmetic applicator can be selected from sphere, ellipse, rhombus, polygonal and the like, and they can be combined or arranged in all possible permutations or combinations.

Figure 9A:
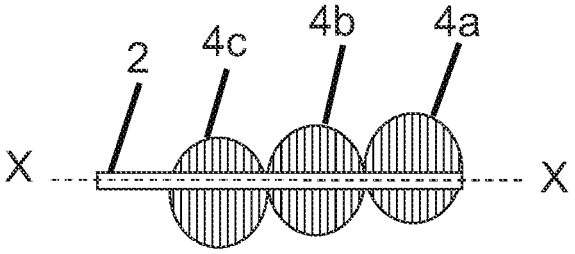
Figure 9B:
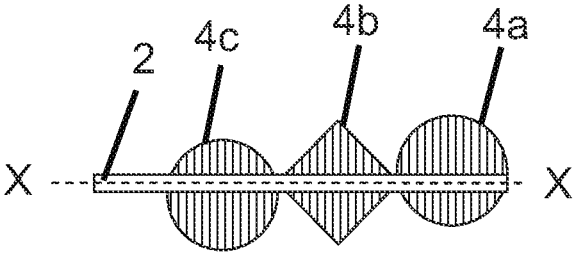

FIGS. 9*a* and 9*b* show further embodiments of the present disclosure, wherein at least of one of the projecting parts is symmetrical relative to a central longitudinal axis X--X of a support 2 and wherein rest of the projecting parts are off-centered relative to central longitudinal axis X--X of the support 2. The projecting parts 4*b* in each of the FIGS. 9*a* and 9*b*, is symmetrical relative to the central longitudinal axis X--X of the support 2 and the projecting parts 4*a* and 4*c* are off-centered relative to the central longitudinal axis X--X of the support 2. Further in FIG. 9*a*, all the projecting parts 4*a*, 4*b*, 4*c* of the cosmetic applicator have a curved outer surface. The cosmetic applicator of FIG. 9*b* comprises projecting parts 4*a*, 4*b*, 4*c* wherein the projecting parts 4*a* and 4*c* have a curved outer surface and the projecting part 4*b* has a sharp edge on the outer surface. It will be apparent to a person having ordinary skill in the art that the shape of the projecting parts of the cosmetic applicator can be selected from sphere, ellipse, rhombus, polygonal and the like, and they can be combined or arranged in all possible permutations or combinations.

Figure 10:
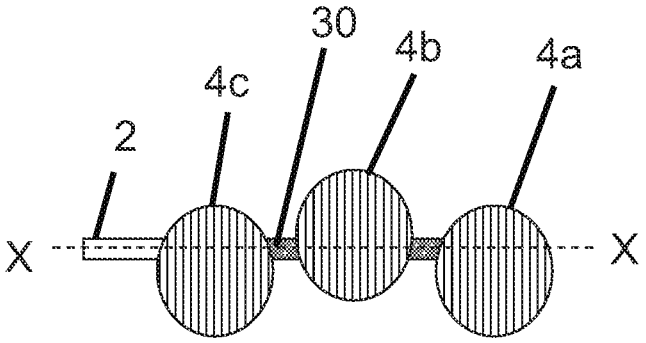
FIG. 10 illustrates sectional view of a cosmetic applicator according to another embodiment of the disclosure.

According to an another embodiment of the present disclosure as shown in the FIG. 10, the cosmetic applicator comprises three successive projecting parts 4*a*, 4*b*, 4*c* extending from the circumferential region of a support 2 such that there is a gap 30 between successive projecting parts 4*a*, 4*b*, 4*c*. The gap can be occupied by application elements having uniform or non-uniform length. The application elements are selected from bristles, tines, teeth, fibers, sponge, disc, flocked applicator elements and the like.

While there have been described what are at present considered to be the preferred embodiments of this disclosure, it will be obvious to those skilled in the art that various changes and modifications may be made without departing from the disclosure and it is therefore aimed to cover all such changes and modifications that fall within the true spirit and scope of the disclosure.

What is claimed is:

1. A cosmetic applicator comprising:

a molded support elongated along a central longitudinal axis;

at least three successive projecting parts and wherein each of the at least three successive projecting parts includes a plurality of successive application elements extending outward from the molded support;

wherein envelope formed by free ends of the plurality of successive application elements of one of the at least three successive projecting parts has a curved outer surface with respect to the central longitudinal axis;

wherein each of the at least three successive projecting parts is off-centered relative to the central longitudinal axis of the support;

wherein the cosmetic applicator includes a first face and a second face;

wherein the first face and the second face lie on opposite sides of a plane containing the central longitudinal axis;

wherein at least one projecting part of the at least three successive projecting parts is off centered towards the first face and is placed between two projecting parts that are off centered towards the second face;

wherein the at least one projecting part off-centered towards the first face has plurality of successive application elements of longer length on the first face as compared to corresponding successive application elements on the second face; and wherein the two projecting parts that are off-centered towards the second face have plurality of successive application elements of longer length towards the second face as compared to corresponding successive application elements on the first face.

2. A cosmetic applicator according to claim 1, wherein length of the plurality of successive application elements of the at least one projecting part progressively increases and then decreases from one end to another end of said at least one projecting part.

3. A cosmetic applicator according to claim 1, wherein a line joining centers of two successive projecting parts of the at least three successive projecting parts is not parallel to the central longitudinal axis of the molded support and does not intersect the central longitudinal axis of the support.

4. A cosmetic applicator according to claim 1, wherein the at least three successive projecting parts define a concave area on the second face of the cosmetic applicator.

5. A cosmetic applicator according to claim 1, wherein the at least three successive projecting parts define a convex area on the first face of the cosmetic applicator.

6. A cosmetic applicator according to claim 1, wherein the at least three successive projecting parts are disposed on the molded support such that there is no gap between the successive projecting parts along the central longitudinal axis of the molded support.

7. A cosmetic applicator according to claim 1, wherein the at least three successive projecting parts are disposed on the molded support such that there is a gap between the successive projecting parts along the central longitudinal axis of the molded support.

8. A cosmetic applicator according to claim 1, wherein the plurality of successive application elements extend perpendicularly to the central longitudinal axis of the support.

9. A cosmetic applicator according to claim 1, wherein the molded support and the application elements of the first face are made of a material different from a material of the molded support and the application elements of the second face of the cosmetic applicator.

10. A cosmetic applicator according to claim 9, the material of the molded support and the application elements of the first face differ from the material of the molded support and the application elements of the second face in one of the properties selected from a group of hardness, tactile feel, color, chemical nature, magnetic property and temperature property.

11. A cosmetic applicator according to claim 1, the cosmetic applicator is a component of a cosmetic applicator assembly including a gripping member and a stem, and wherein a proximal end of the stem is connected to the gripping member while the cosmetic applicator is connected to a distal end of the stem.

12. A cosmetic applicator according to claim 1, wherein the plurality of successive application elements are molded integrally with the molded support out of a thermoplastic material.

13. A cosmetic applicator for applying a cosmetic product, the cosmetic applicator comprising:

a molded support elongated along a central longitudinal axis;

at least three successive projecting parts and wherein each of the at least three successive projecting parts includes a plurality of successive application elements extending outward from the molded support;

wherein envelope formed by free ends of the plurality of successive application elements of one of the at least three successive projecting parts has a sharp edge on its outer surface;

wherein the at least three successive projecting parts are off-centered relative to the central longitudinal axis of the molded support;

wherein the cosmetic applicator includes a first face and a second face opposite to the first face;

wherein the first face and the second face lie on opposite sides of a plane containing the central longitudinal axis;

wherein at least one projecting part of the at least three successive projecting parts is off centered towards the first face and is placed between two projecting parts that are off centered towards the second face;

wherein the at least one projecting part off-centered towards the first face has plurality of successive application elements of longer length on the first face as compared to corresponding successive application elements on the second face; and wherein the two projecting parts that are off-centered towards the second face have plurality of successive application elements of longer length towards the second face as compared to corresponding successive application elements on the first face.

14. A cosmetic applicator comprising:

a rectilinear molded support;

at least three successive projecting parts wherein each of the at least three successive projecting parts comprises a plurality of successive application elements extending outward from the molded support;

wherein each of the at least three successive projecting parts are off-centered relative to a central longitudinal axis of the applicator;

wherein the cosmetic applicator includes a first face and a second face;

wherein the first face and the second face lie on opposite sides of a plane containing the central longitudinal axis;

wherein a first projecting part of the at least three successive projecting parts is off centered towards the first face;

wherein a second projecting part adjacent to the first projecting part of the at least three successive projecting parts is off centered towards the second face;

wherein the first projecting part off-centered towards the first face has plurality of successive application elements of longer length on the first face as compared to corresponding successive application elements on the second face; and wherein the second projecting off-centered towards the second face has plurality of successive application elements of longer length towards the second face as compared to corresponding successive application elements on the first face.

* * * * *